United States Patent [19]

Bove et al.

[11] 4,207,076

[45] Jun. 10, 1980

[54] GASOLINE-ETHANOL FUEL MIXTURE SOLUBILIZED WITH ETHYL-T-BUTYL ETHER

[75] Inventors: Francis S. Bove, Wappingers Falls; Sheldon Herbstman, Spring Valley, both of N.Y.

[73] Assignee: Texaco Inc., White Plains, N.Y.

[21] Appl. No.: 14,506

[22] Filed: Feb. 23, 1979

[51] Int. Cl.[2] ..... C10L 1/18

[52] U.S. Cl. ..... 44/56; 44/53; 44/77

[58] Field of Search ..... 44/56, 77, 53

[56] References Cited

U.S. PATENT DOCUMENTS

| | | | |
|---|---|---|---|
| 1,361,153 | 12/1920 | Hayes | 44/56 |
| 1,907,309 | 5/1933 | Van Schaack, Jr. | 44/56 |
| 2,046,243 | 6/1936 | Buc | 44/56 |
| 2,643,942 | 6/1953 | Barusch | 44/56 |

*Primary Examiner*—Robert V. Hines
*Assistant Examiner*—J. V. Howard
*Attorney, Agent, or Firm*—Carl G. Ries; Robert A. Kulason; Henry W. Archer

[57] ABSTRACT

Crude ethyl-t-butyl ether is used as a cosolvent for hydrous ethanol in gasoline fuel mixtures. The ether solubilizes grain alcohol in all proportions in low aromatic content gasolines.

9 Claims, No Drawings

GASOLINE-ETHANOL FUEL MIXTURE SOLUBILIZED WITH ETHYL-T-BUTYL ETHER

FIELD OF THE INVENTION

This invention relates to novel fuel mixtures for use in internal combustion engines. More particularly, the invention relates to solubilizing ethanol containing water in gasoline by means of an additive which provides additional octane rating to the resulting blend and has no adverse effect on its storage stability, water-shedding or corrosion properties.

DESCRIPTION OF THE PRIOR ART

Consideration of the use of grain alcohols as an automotive fuel is as old as the internal combustion engine itself. It is reported, for example, in a 1907 U.S. Department of Agriculture report entitled "Use of Alcohol and Gasoline in Farm Engines". Later in 1938, the USDA issued another report entitled "Motor Fuel from Farm Products".

Use of commercial ethanol in gasoline blends can cause phase separation problems because of water-containing ethanol's limited solubility in gasoline, particularly, in low aromatic content gasolines sold in certain countries.

Various attempts to solve this solubility problem are described in the publication Hydrocarbon Processing 56 (II) 295-299 (November 1977). The article describes the effect of methyl-t-butyl ether on dry methanol and how methanol solubility relates to the aromatic content of gasoline. More importantly, the article unequivocally states that this ether does not substantially improve the water tolerance of methanol.

OBJECTS AND SUMMARY OF THE INVENTION

One of the principal objects of this invention is to provide an improved fuel composition wherein hydrocarbons in gasoline boiling point range and ethanol components are maintained in a single phase by a cosolvent.

Another object of the invention is provide an improved fuel consisting of a major amount of gasoline and a minor amount of ethanol or grain alcohol with an alkyl-t-butyl ether as its cosolvent.

In accordance with the present invention, from 9 to 12 percent of crude alkyl (preferably ethyl) -t-butyl ether bottoms is blended in with a fuel consisting of 70 to 84 percent gasoline and 5 to 20 percent of 95 percent (or "wet") ethanol.

For obvious economic reasons the ethyl-t-butyl ether (ETBE) used here preferably is of the type referred to as "crude ETBE bottoms" which is the higher boiling constituent left in the reactor when excess grain alcohol is reacted with isobutylene over a sulfonated resin. This material is a mixture of t-butyl alcohol, ethanol and hydrocarbons as well as ethyl-t-butyl ether. This material has been found to solubilize grain alcohol in gasoline in all proportions thereby allowing a wide latitude in the precise amount of ethanol which can be blended with the gasoline. In addition the presence of this material in the blend considerably increases its octane rating.

SUMMARY OF THE INVENTION

This invention is a fuel comprising a major amount of gasoline, a minor amount of hydrous ethanol and a cosolvent amount of crude alkyl-t-butyl ether bottoms.

DISCLOSURE OF THE INVENTION

Various fuel blends were compared for solubility, octanes, and oxidation stability using 95 ETOH, a Brazilian type base fuel simulated from a U.S. unleaded gasoline and prepared ETBE.

The results obtained with blends according to the invention are given below.

SOLUBILITY

Table I provides a summary of solubility results obtained. It can be seen that addition of ETBE served to improve the solubility properties of the 95% ETOH by acting as a cosolvent. In fact, if the gasoline contained 12 percent by volume ETBE (estimated ETBE blending concentration basis conversion of all available isobutylene) the 95% ETOH would be soluble at all practical concentrations. It appears that both fuel composition and temperature greatly affect 95% ETOH solubility, whereas when 100% ethanol was used, no solubility problems were encountered. For example, although at room temperature the 95% ETOH was not soluble in the Brazilian type gasoline (contains 12.5 percent aromatics and 11.0 percent olefins) at any concentration studied (up to 32 vol. %), it was soluble in a U.S. type lead-free gasoline (contains 32 percent aromatics and 9.5 percent olefins) at 18 volume percent and greater. However, even in the higher aromatic fuel, phase separation occurred at 48° F. Neither the U.S. nor the Brazilian type gasoline posed any solubility problems when 100% ethanol was used.

In an effort to determine minimum volume requirements of ETBE to solubilize 95% ETOH in the Brazilian gasoline it was found that lower 95% ETOH concentrations and reduced fuel temperatures required greater additions of ETBE to obtain a one phase system.

| Gasoline-Alcohol Composition, Vol. % | | Vol. % ETBE Mixture Addition Required to Obtain Single Phase System | |
|---|---|---|---|
| Gasoline | 95-ETOH | At 70° F. | At 40° F. |
| 83 | 17 | 2.0 | 8.0 |
| 90 | 10 | 11.0 | 14.0 |

Since the results were obtained using an ETBE mixture rather than high purity ETBE, the volume required of 99+ purity ETBE necessary to obtain one phase was checked with the gasoline-95 ETOH system at 70° F. and gave similar results.

OCTANE RATING INCREASE

Table II provides a summary of octane results obtained. The octane upgrading potential using ETBE mixture and 95% ETOH was very favorable. The results indicate that using either pure or 95% ETOH provides blending octanes of 113–131.

STABILITY AND PEROXIDE FORMING TENDENCIES

A summary of blend peroxide numbers and oxidation stabilities are provided in Table III for gasoline containing ETOH, ETBE or both. Compared to the base fuel, no significant differences were observed with any of the blends. It should be noted that the base fuel was prepared from U.S. refinery stocks, which are inhibited with an antioxidant at the refinery.

PEROXIDE BUILDUP IN ETBE

Peroxide buildup in the neat ETBE after 4 weeks storage is summarized in Table IV. The ETBE samples were stored in metal (steel) cans and aerated three times weekly for four weeks at ambient temperatures.

The Active oxygen of freshly prepared ETBE was 0.0055 wt. % compared to 0.025 wt. % for the aerated samples. Under these relatively severe aerating conditions there was a 4–5 fold increase in peroxide formation. The 0.025 wt. % active oxygen content is equivalent to about 0.25 wt. % ether hydroperoxide content in the ETBE.

Addition of a phenylene diamine type antioxidant inhibits peroxide formation at 30 pounds per 1000 barrels (PTB) in the neat ETBE. This would be equivalent to 3-PTB in gasoline containing 10 volume % ETBE. It is possible that lower dosages of antioxidant are sufficient to inhibit peroxide formation.

WATER SHEDDING PROPERTIES

The water-shedding properties of the simulated Brazilian unleaded base fuel containing 12(v) percent ETBE and 10 (v) percent 95% ETOH are considered satisfactory and equivalent to the base fuel. The fuels were contacted with 5(v) percent laboratory buffered water bottoms, ranging in pH from 5–12, the results of which are summarized in Table V. Based on the large volume increase of the $H_2O$ layer (over 3 fold), considerable extraction of ethanol and/or ETBE from the fuel occurred with all water bottoms.

CORROSION PROTECTION

The anti-corrosion property of a fuel containing 12(v) percent ETBE and 10(v) percent 95% ETOH was evaluated in the NACE Test and the results are summarized in Table VI. The test fuel provided excellent corrosion protection and was equivalent to a fuel containing 18(v) percent 95% ETOH. Since the Brazilian gasoline containing 95% ETOH could not be evaluated for corrosion protection due to solubility problems previously identified, a U.S. type base fuel was used to obtain a corrosion protection comparison between the gasoline-/ETBE/95% ETOH and gasoline/95% ETOH blends.

While the foregoing disclosure has illustrated the invention mainly by reference to the use of ethyl-t-butyl ether bottoms as the cosolvent, it is to be understood that this ether can be replaced by its alkyl homologs in particular by crude methyl-t-butyl ether bottoms.

Obviously, many modifications and variations of the invention hereinbefore set forth maybe made without departing from the spirit and scope thereof and therefore only such limitations should be imposed thereon as are indicated in the appended claims.

TABLE I

Solubility Studies

| Gasoline Type | Composition, Vol. % Gasoline | ETBE(1) | ETOH(2) | Solubility At 70° F. | At 48° F. |
|---|---|---|---|---|---|
| Brazilian(A) | 83.0 | 0 | 17.0 | Insoluble (I) | I |
| Brazilian | 78.0 | 12.0 | 10.0 | Soluble (S) | S |
| Brazilian | 76.0 | 12.0 | 12.0 | S | S |

TABLE I-continued

Solubility Studies

| Gasoline Type | Composition, Vol. % Gasoline | ETBE(1) | ETOH(2) | Solubility At 70° F. | At 48° F. |
|---|---|---|---|---|---|
| Brazilian | 73.0 | 12.0 | 15.0 | S | S |
| Brazilian | 83.6 | 11.4** | 5.0 | S | S |
| Brazilian | 79.2 | 10.8** | 10.0 | S | S |
| Brazilian | 74.8 | 10.2** | 15.0 | S | S |
| Brazilian | 70.4 | 9.6** | 20.0 | S | S |
| U.S.(B) | 82.0 | 0 | 18.0 | S*** | I |

(1)As prepared ETBE contains, % wt: 71.56 ETBE, 13.72 t-butyl alcohol, 11.08 ETOH, 3.60 $nC_5$.
(2)Commercial grade Ethanol: (95 vol. % ETOH + 5 vol. % $H_2O$).
(A)Simulated Brazilan type base fuel (12.5% Aromatics = 11.0% Olefins)
(B)U.S. type lead-free base fuel (32.0% Aromatics = 11.0% Olefins)
*Evaluated at 2–32 vol. % in the gasoline and unable to obtain solubility.
**Equivalent to 12 vol. % ETBE in the gasoline before ETOH addition.
***Not soluble below 18 vol. %.

TABLE II

Brazilian Gasoline Octane Studies

| Fuel Composition, Vol.% Base[1] | ETBE[2] | ETOH[3] | Fuel Octanes RON | MON |
|---|---|---|---|---|
| 100 | 0 | 0 | 76.0 | 72.4 |
| 78 | 12 | 10 | 88.8 | 81.3 |
| 76 | 12 | 12 | 89.8 | 82.0 |
| 73 | 12 | 15 | 91.8 | 82.9 |
| 88 | 12 | 0 | 82.3 | 77.6 |
| 83 | — | 17* | 87.9 | 80.7 |

[1]Simulated Brazilian Gasoline (contains 60 v% Lt St. Run, 20v% Full Range FCC, 20v% LT.FCC).
[2]ETBE - Analysis, wt. % by Gas chromatography: ETBE-71.56, t-butyl alcohol-13.72, ethanol-11.08, n-C −3.60, unid-0.03, *H20-Tr.,
[3]Commercial grade ethanol (95v% ETOH + 5v% $H_2O$). *Using 100% ethanol instead of 95% due to 95% ETOH solubility problems.

TABLE III

Oxidation Stability and Peroxide Formation

| Fuel Composition, Vol. % Base[1] | ETBE[2] | ETOH[3] | Peroxide Number[4] | ASTM Stability[5] |
|---|---|---|---|---|
| 100 | 0 | 0 | 0 | 24 hours + |
| 95 | 5 | 0 | 0 | " |
| 90 | 10 | 0 | 0 | " |
| 85 | 15 | 0 | 0.05 | " |
| 95 | 0 | 5* | 0.10 | " |
| 90 | 0 | 10* | 0.05 | " |
| 85 | 0 | 15* | 0.05 | " |
| 80 | 0 | 20* | 0.05 | " |
| 78 | 12 | 10 | 0.05 | " |
| 76 | 12 | 12 | 0.05 | " |
| 73 | 12 | 15 | 0.15 | " |

*Used 100% ETOH in these blends.
[1]Simulated Brazilian Type Gasoline: 60 v/% Lt. St. Run 20v% Full Range gasoline, 20v% light gasoline.
[2]ETBE, Comp. wt. %: 71.56 ETBE, 13.72 t-butyl alcohol, 11.08 Ethanol, 3.60 n-$C_4$.
[3]Commercial Grade Ethanol (95v% ETOH + 5v% $H_2O$) unless otherwise identified.
[4]Standard of Indiana Test - meq active $O_2$ per liter gaso.
[5]Oxidation Stability ASTM-D-525.

TABLE IV

PEROXIDE BUILDUP IN ETBE

Conditions: Stored Samples in Steel Containers over a four week period at ambient temperatures and aerated three times weekly.

| Blend | Active Oxygen, % | Avg. | Peroxide Number* |
|---|---|---|---|
| ETBE (Stored over Nitrogen) | .0055<br>.029 | .0055 | 5.0 |
| ETBE (Aerated) | .021<br>0.029 | .025 | 23.2 |
| ETBE + 31 PTB Dupont AO-30[a] | .030<br>0.013 | .030 | 27.9 |
| ETBE + 31 PTB UOP-5[b] | 0.017<br>0.015 | .015 | 14.0 |

TABLE IV-continued

PEROXIDE BUILDUP IN ETBE

Conditions: Stored Samples in Steel Containers over a four week period at ambient temperatures and aerated three times weekly.

| Blend | Active Oxygen, % | Avg. | Peroxide Number* |
|---|---|---|---|
| ETBE + 62 PTB UOP-5[b] | 0.005 | .010 | 9.3 |

*Equivalent Peroxide Number calculated from Active Oxygen Analysis. Peroxide No. = (Active Oxygen (WT-%) × 7.4 × 1000)/8

[a]Hindered phenol type antioxidant.

[b]Phenylene diamine type antioxidant.

TABLE V

Waring Blendor Emulsion Test Results[1]

| Fuel | Water Bottom | Haze Reading 4 Hr | Haze Reading 24 Hr | Water Bottom Volume, ml* |
|---|---|---|---|---|
| Simulated Brazilian | pH 5 Buffer | 25 | 6 | 15 |
| Unleaded | pH 12 Buffer | 62 | 25 | 25 |
| Base (SBUB) | Dist. $H_2O$ | 16 | 3 | 15 |
| 78(v)% SBUB + 12 (v)% | pH 5 Buffer | 47 | 3 | 65 |
| ETBE + 10 (v) | pH 12 Buffer | 63 | 9 | 65 |
| % 95 ETOH | Dist. $H_2O$ | 31 | 3 | 65 |

[1]475 ml fuel spun with 25 ml water bottom for 10 seconds at ~ 13,000 rpm in a blender. Fuel allowed to settle and rated for haze after 4 and 24 hours using a photoelectric cell. Haze readings range from 0 (Clear) to 200 (mayonnaise-like emulsion) with ratings below 100 generally considered as acceptable.

*Volume after 24 hours.

TABLE VI

NACE TEST RESULTS[1]

| Fuel | % Rust |
|---|---|
| Simulated Brazilian Unleaded Base (SBUB) | 50–100 ck 50–100 ck 50–100 |
| 78(v)% SBUB + 12(v)% ETBE + 10(v)% 95 ETOH | Trace ck Trace ck Trace |

TABLE VI-continued

NACE TEST RESULTS[1]

| Fuel | % Rust |
|---|---|
| Unleaded Base Fuel[a] (UBF) | 50–100 ck 50–100 ck 50–100 |
| 78(v)% UBF + 12(v)% ETBE + 10(v)% 95% ETOH | Trace ck Trace ck Trace |
| 82(v)% UBF + 18(v)% 95% ETOH[b] | Trace ck Trace ck Trace |

[1]In this test a steel spindle is suspended in a stirred mixture of 90% fuel and 10% distilled water for 3.5 hours at 100° F. The spindle is visually rated for rust. One percent or less rust passes the test.

[a]Simulated U.S. base, 32% aromatics.

[b]ETOH separated upon standing. Fuel was shaken and tested as a hazy blend.

What is claimed is:

1. In a fuel consisting essentially of a major amount of gasoline, a minor amount of hydrous ethanol the improvement consisting of a cosolvent amount of crude alkyl-t-butyl ether bottoms.

2. The fuel of claim 1, wherein said ethanol contains about 5 percent of water.

3. The fuel of claim 1, consisting essentially of from 70 to 89 percent of gasoline; 5 to 20 percent of hydrous ethanol and 1 to 12 percent of ethyl-t-butyl ether bottoms.

4. The fuel of claim 1, wherein said bottoms consists of about 71 percent of ethyl-t-butyl ether; about 13 percent of t-butyl alcohol; about 11 percent of ethanol and about 3.60 percent of $C_5$ hydrocarbons.

5. The fuel of claim 1, containing also an antioxidant.

6. The fuel of claim 5, wherein said antioxidant is phenylene diamine.

7. The fuel of claim 1, wherein said gasoline has a low aromatic content of 5 to 15 volume percent.

8. A process for stabilizing hydrous ethanol in gasoline which comprises blending with said ethanol and said gasoline a cosolvent amount of ethyl-t-butyl ether.

9. The process of claim 8, wherein the amount of ethanol ranges from 5 to 20 volume percent, the volume of gasoline ranges from 70 to 89 volume percent and said amount of ether ranges from 1 to 12 volume percent.

* * * * *